US006663224B2

(12) United States Patent
Rivas et al.

(10) Patent No.: US 6,663,224 B2
(45) Date of Patent: Dec. 16, 2003

(54) ORIFICE PLATE WITH BREAK TABS AND METHOD OF MANUFACTURING

(75) Inventors: Rio T Rivas, Corvallis, OR (US); Garrard Hume, Corvallis, OR (US); Angela W Bakkom, Corvallis, OR (US); Gerald G Trunk, Monmouth, OR (US); Niranjan Thirukkovalur, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/849,024

(22) Filed: May 4, 2001

(65) Prior Publication Data

US 2002/0163558 A1 Nov. 7, 2002

(51) Int. Cl.[7] ..... B41J 2/16
(52) U.S. Cl. ..... 347/47; 29/890.1
(58) Field of Search ..... 29/890.1; 347/40, 347/44, 45, 49, 47

(56) References Cited

U.S. PATENT DOCUMENTS

| | | | | | |
|---|---|---|---|---|---|
| 5,194,877 | A | | 3/1993 | Lam et al. | 29/890.1 |
| 5,900,892 | A | * | 5/1999 | Mantell et al. | 347/45 |
| 6,109,728 | A | * | 8/2000 | Kakuda et al. | 347/45 |
| 6,312,120 | B1 | * | 11/2001 | Ando et al. | 347/40 |

* cited by examiner

*Primary Examiner*—Judy Nguyen
*Assistant Examiner*—Julian D. Huffman

(57) ABSTRACT

A plate has a rectangular plate body with a plurality of nozzle arrays. The plate also has first and second end zones in between the plurality of nozzle arrays and opposing ends of the plate body, respectively. There is a break tab in at least one of the first and second end zones. In between the first and second end zones is a middle zone. A plating material encapsulates the plate body in the middle zone.

16 Claims, 9 Drawing Sheets

ORIFICE PLATE WITH BREAK TABS AND METHOD OF MANUFACTURING

FIELD OF THE INVENTION

This invention relates to ink jet printers, and particularly manufacture of orifice plates for use with ink jet printers and assembly therewith.

BACKGROUND

Generally, thermal ink jet printers have a print cartridge. The print cartridge often includes a print head having an orifice plate defining one or more arrays of numerous orifices through which droplets of fluid are expelled onto a medium to generate a desired pattern.

An orifice plate has a core plate material that is typically formed of a metal. Typically, an area of the core plate material is exposed during the manufacturing process. Often, the metals forming the core plate material are susceptible to corrosion by some fluids used in the cartridges. Further, the metal in the orifice plate sometimes forms a galvanic cell with some of the fluids used in the cartridge. With corrosion or the formation of a galvanic cell with the orifice plate, the cartridge is more likely to be rendered inoperable prematurely.

Often the exposed areas of the plate are encapsulated with an inert coating. However, the coating often extends over the plate to at least partially block the orifices through which fluid is to be expelled in a printing process. Consequently, an adequate margin between the orifices and exposed areas is employed. The size of the print head die onto which the plate is attached is thereby directly affected. It is desired to minimize the size of the print head die due to the costs associated with the material used therein. Accordingly, it is desired to manufacture orifice plates that minimize print head die size, resist corrosion and minimize galvanic cell formation.

SUMMARY

In one embodiment, a plate has a rectangular plate body with a plurality of nozzle arrays. The plate also has first and second end zones in between the plurality of nozzle arrays and opposing ends of the plate body, respectively. There is a break tab in at least one of the first and second end zones. In between the first and second end zones is a middle zone. A plating material encapsulates the plate body in the middle zone.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
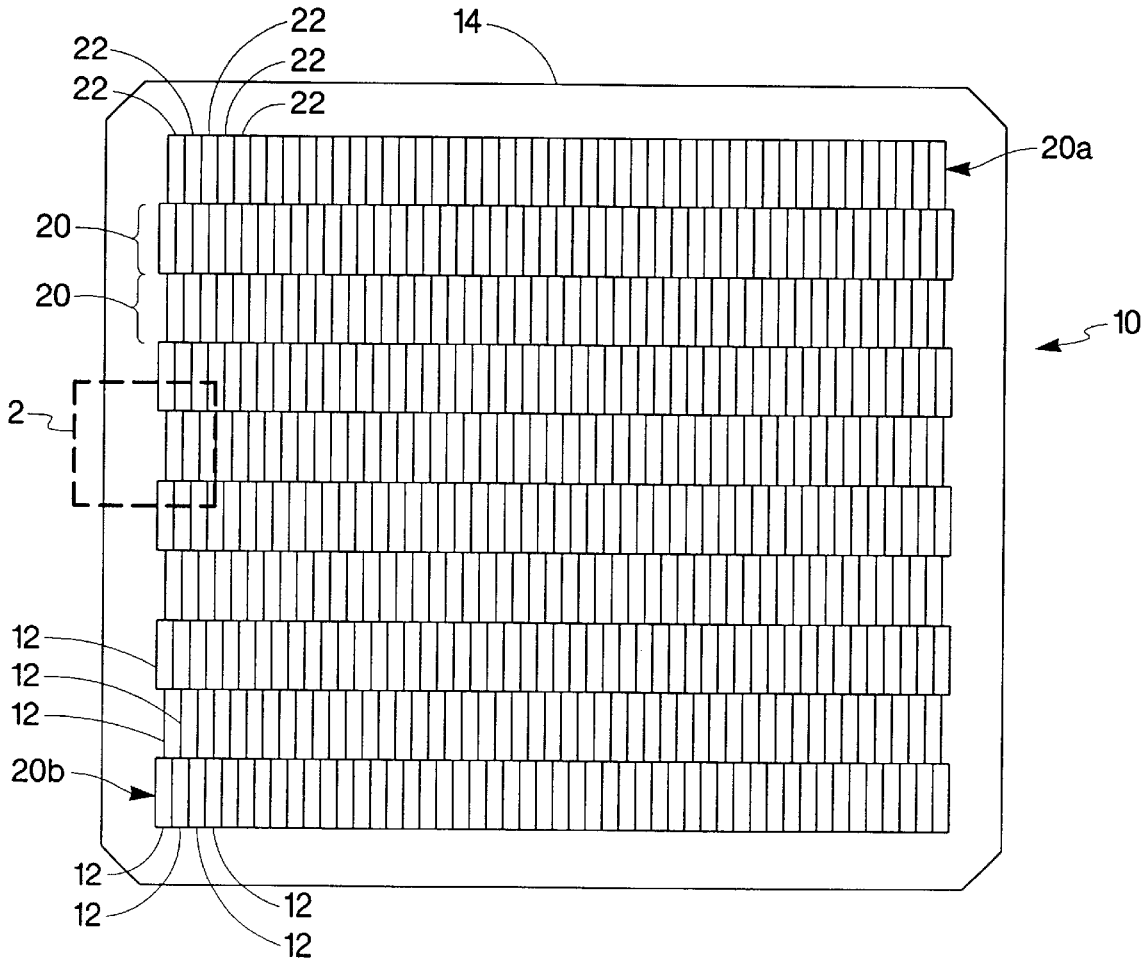
FIG. 1 is a plan view of a sheet of intercoupled orifice plates according to one embodiment of the invention.

In the embodiment shown in FIG. 1, a sheet 10 has a multitude of intercoupled orifice plates 12. The sheet includes a peripheral frame 14 that surrounds the plates, and that provides structural support of the sheet and alignment of the plates.

In one embodiment, the plates 12 are arranged in rows 20 and columns 22, with more columns than rows. In one embodiment, the rows 20 are staggered, in that the plates of one row are offset from the plates of the adjacent rows. In the embodiment shown in FIG. 1, the offset is about one half the center-to-center spacing of the plates every other row.

In one embodiment, the sheet 10 is a square. In the embodiment illustrated, the sheet has sides of about 190 mm in length. In another embodiment, the sheet has a length and width found in a range of about 150 to 500 mm. In other embodiments the sheet length and width are determined by a desired number of plates per sheet, and/or a desire to have a sheet size that is compatible with manufacturing equipment sizes. A sheet thickness (and thus plate thickness) is about 29 $\mu$m. In alternative embodiments, the sheet thickness is found in a range from about 15 to 55 $\mu$m. The frame has a width of approximately 20 mm around the sides of the sheet. In alternative embodiments, the frame has a width that is found in a range from about 10 to 100 mm. In one embodiment, the frame size is determined based on the desired level of sheet structural integrity and stiffness.

Figure 2:
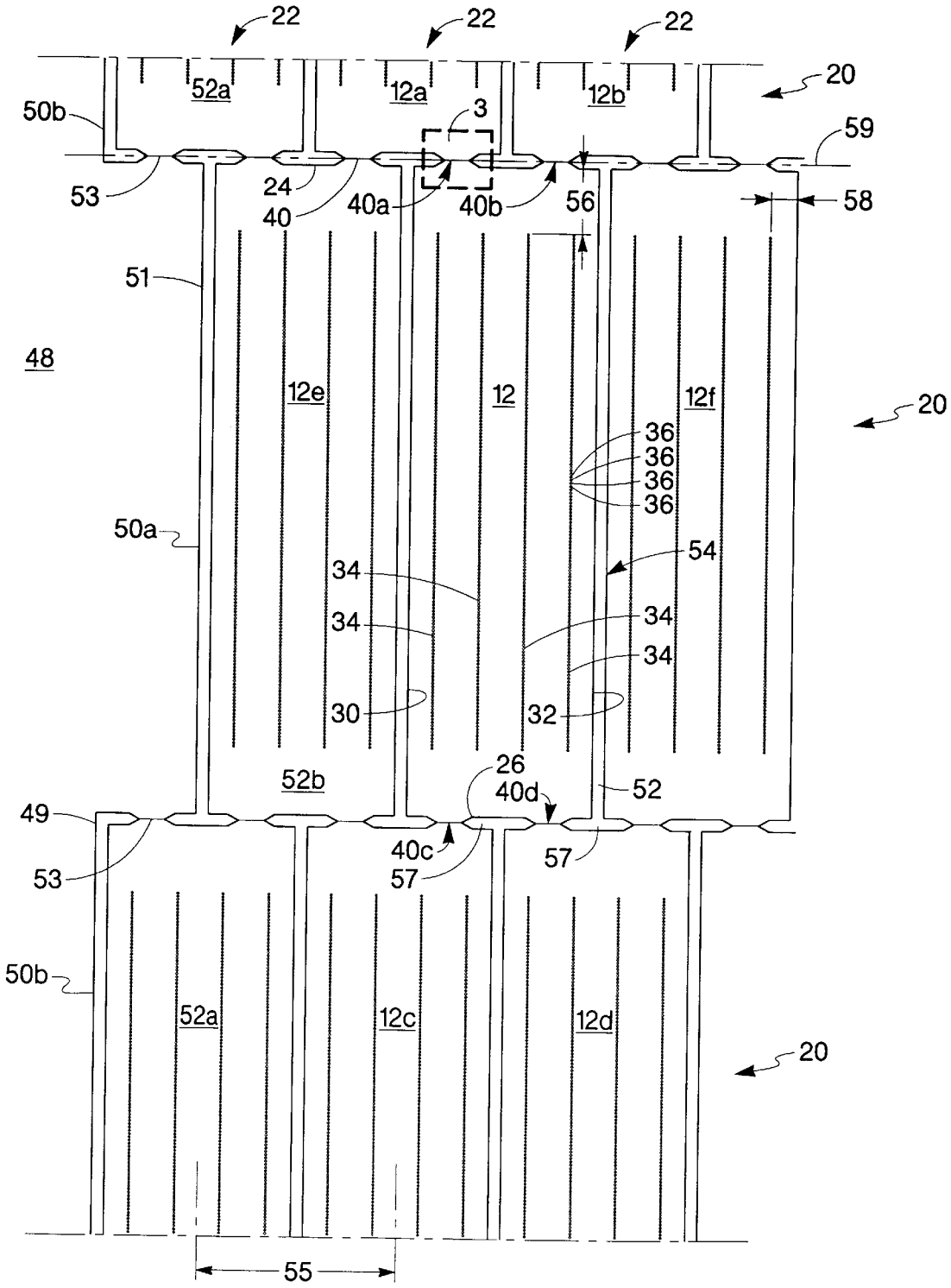
FIG. 2 is an enlarged view of section 2 of FIG. 1.

In the embodiment shown in FIG. 2, each plate 12 is substantially identical to the other plates in the sheet 10. In alternative embodiments, the sheet has different plate designs. In one embodiment, each plate is an elongated rectangle having a width of about 2.7 mm and a length of about 10.6 mm. In another embodiment, the width is about 2.2 mm. In another embodiment, the width is about 2.6 mm. In another embodiment, the width is about 3.5 mm. In another embodiment, the width is about 7 mm and the length is about 7.6 mm. In another embodiment, the width of the plate is found in a range of from about 2 to 20 mm, and the length is found in a range from about 5 to 20 mm. In another embodiment, the length and width of the plate depends on the demands of the application, including desired swath height, number of orifice arrays, and resolution. In one embodiment, the plate has an aspect ratio of about 4:1. In another embodiment, the aspect ratio is found in a range of from about 1:1 up to 8:1, for longer orifice arrays.

Each plate 12 has opposed first and second end edges 24, 26, and opposed first and second side edges 30, 32. In the embodiment shown in FIG. 2, the end edges are along plate sides which are shorter than those of the side edges.

In one embodiment, the sheet of plates has a core plate material. In one embodiment, the core plate material is plated over a substrate. In one embodiment, the substrate is glass, in another the substrate is metal. In one embodiment, the core plate material is nickel. The core plate material is peeled from the substrate and dipped into an electroplating bath to coat with a plating material 80 or protective coating. In another embodiment, the core plate material is formed by dipping a metal form into an electroplating bath and plating the metal form with a combination of nickel and a plating material 80. The plating is then peeled off the metal form to become the sheet of orifice plates.

In one embodiment, the plating material 80 is gold or another precious metal, such as palladium (Ni—Rh, Ni—Pd, or Ni—Au). In one embodiment, the plating material 80 is corrosion resistant. These sheets are generally 20 to 50 μm thick. In one embodiment, the core plate material is nickel with a thickness of about 27 μm, and is coated with palladium having a thickness of about 1.5 μm. The plates in the sheet and break tabs therebetween are formed in the plating process. In alternative embodiments, the nickel plating ranges between about 13 to 53 μm, and the palladium thickness ranges between 0.3 to 2.0 μm. In another embodiment, the amount of precious metal is minimized, while plating reliability is maintained.

The sheet of plates has opposing surfaces which are plated with the plating material 80. Additionally, the end edges 24, 26, including the break tabs, and the side edges 30, 32 of the plates are plated with the plating material 80.

In the embodiment illustrated in FIG. 2, the plate 12 includes four arrays 34 of nozzles 36. In one embodiment, each of the four nozzle arrays corresponds to a different color that is supplied from a fluid reservoir or fluid chamber in a printer cartridge. In an alternative embodiment, the number of arrays in the plate range from about 1–12. In another embodiment, at least two of the nozzle arrays correspond to a same color.

Each plate 12 is coupled with the sheet 10 using at least one break tab 40. In the embodiment illustrated in FIG. 2, there are four small break tabs 40*a*, 40*b*, 40*c*, 40*d* for the plate 12. The break tabs 40*a*, 40*b* extend from the end edge 24 of the plate. The break tabs 40*c* and 40*d* extend from the end edge 26 of the plate. The break tabs 40*a* and 40*b*, and the break tabs 40*c* and 40*d*, are spaced apart from each other along the end edges 24 and 26, respectively. In the embodiment shown, the side edges 30, 32 of each plate are substantially straight, and do not include break tabs. This embodiment with no break tabs on the side edges enables the adjacent plates to be fabricated in closer proximity, which in turn provides the economic advantage of more plates per sheet. In one embodiment, the gap between the adjacent plates is about 120 μm. In another embodiment, the gap between the adjacent plates is about 80 to 120 μm, in particular, 80 to 100 μm.

For each break tab 40 in the plate 12, there is a corresponding break tab 40 in one of the plates that are adjacent. The break tabs 40 of the adjacent plates are coupled with each other, thereby coupling the adjacent plates in the sheet.

The sheet has an end column adjacent the frame portion 48. In the embodiment shown in FIG. 2, the rows 20 of the plates in the sheet are staggered giving an outer edge of the end column 22 a corrugated shape. Along the end column are exterior end plates 52*a* and interior end plates 52*b*. The plates in the end column alternate between the exterior end plate 52*a* and the interior end plate 52*b*. In the embodiment shown, the exterior end plates 52*a* extend about half the width of a plate past the interior end plates 52*b*.

In one embodiment, along sides of the frame is a frame portion 48. The frame portion 48 has an interior boundary 49. The interior boundary 49 corresponds with the end column of the sheet of plates such that there is a substantially consistently sized gap 51 in between the end column and the interior boundary. The interior boundary 49 has a shape that corresponds to the shape of the outer edge of the end column 22. Accordingly, the interior boundary 49 is shaped in a corrugated shape opposite to the corrugated shape of the end column of FIG. 2.

The interior boundary 49 has protruding portions 50*a* that correspond to the interior end plate 52*b*, and thus the protruding portions 50*a* have the same length as the plates. Likewise, the interior boundary 49 has indented portions 50*b* that correspond to the exterior end plate 52*a*. The indented portions 50*b* receive the adjacent exterior end plate 52*a* in the staggered configuration.

In one embodiment, the sheet of plates is attached to the frame in the same manner as the plates are coupled to their adjacent plates. The exterior end plate 52*a* has a break tab 53 that extends from both end edges of the plate 52*a*. The break tab 53 couples with corresponding a break tab along the interior boundary 49 of the frame, as shown in FIG. 2. In one embodiment, a top row 20*a* and a bottom row 20*b* of plates are coupled to the frame through the break tabs 40 along the top end edges and bottom end edges of the plates, respectively. The interior boundary 49 adjacent the top row 20*a* and the bottom row 20*b* of plates has break tabs that correspond to the break tabs 40.

The plates 12 that are adjacent in one of the rows 20 are spaced apart by an I-shaped elongated gap 54 that extends the length of the plate. Flanges of the I-shaped gap are end segments 57 formed substantially perpendicular to a web portion of the gap 54. The gap 54 terminates at each end segment 57 by abutting one of the end edges 24, 26 of the plate in the adjacent row. The end segment 57 has a length determined by the distance between two adjacent break tabs. Thus, a total length of any gap 54 is greater than the length of the side edge 30, because the length of the end gap segments 57 are included in the total length. In another embodiment, a length of the gap 54 corresponds to the longest span of unsupported plate material. A width of the gap 54, including end segment 57, is about 120 μm between adjacent plates and adjacent rows. In alternative embodiments, the gap width ranges from about 20 to 200 μm. In another embodiment, the gap width is minimized to allow more plates per sheet.

Each break tab of the plate 12 is coupled to a different one of the plates in one of the adjacent rows. The plate 12 is coupled with plates 12*a*, 12*b*, 12*c*, and 12*d*. The plates 12*a* and 12*b* are in the adjacent row above the plate 12, while the plates 12*c* and 12*d* are in the adjacent row below the plate 12. The break tabs 40*a*, 40*b*, 40*c*, and 40*d* couples the plate 12 with the plates 12*a*, 12*b*, 12*c* and 12*d*, respectively.

In one embodiment, adjacent plates in a common row are indirectly coupled through plates in adjacent rows. In particular the plate 12 is indirectly coupled with plates 12*e*, 12*f* that are in the same row as the plate 12. The plate 12*e* is coupled with the plate 12 through either the plate 12*a* or the plate 12*c*. The plate 12*f* is coupled with the plate 12 through either the plate 12*b* or the plate 12*d*.

In the embodiment shown in FIG. 2, the break tabs of the plates in one of the rows are aligned with the break tabs of the plates in the adjacent rows. As described in the application, the rows are each offset from adjacent rows a distance that is equal to a distance between adjacent break tabs. In this manner, the break tabs align with the break tabs in the adjacent rows, except for break tabs at the ends of the rows. The break tabs at the end of the rows are in plates 52*a* and couple with the interior boundary 49, as described above.

In one embodiment, the break tabs are spaced apart evenly on the sheet at about half a pitch 55 of the plates. The pitch 55 is the distance between a center line of one plate to a centerline of an adjacent plate. The even spacing of the break tabs permits the stagger amount of about one-half the pitch between rows. In one embodiment, the break tab spacing on each plate is only slightly more than half the width of the plate.

In one embodiment, the nozzle arrays 34 are in a rectangular zone. As shown in FIG. 2, the plate 12 has an end peripheral zone 56 from each end edge 24, 26 to the rectangular zone of the arrays 34. The plate 12 has an side peripheral zone 58 from each side edge 30, 32 to the rectangular zone of the arrays 34. The end peripheral zone is about 982 $\mu$m wide. The side peripheral zone 58 is about 165 $\mu$m wide. In alternative embodiments, the values of the width of the end and side zones 56, 58 range from between about 800 to 1000 $\mu$m, and from between about 100 to 800 $\mu$m, respectively. With the narrow elongated plate shape, the end zones 56 are relatively small compared with the total plate area. The end zones 56 are intended to provide adequate margin for encapsulation of exposed broken end surfaces of the break tabs, as discussed in more detail below. In between the end zones 56 is a middle zone, and in the middle zone is the rectangular array of orifices.

In one embodiment, each break tab 40 has a shape of a trapezoid. Due to the shape of the break tabs, at a junction of the break tabs from adjacent plates, there is a cross-sectional area that is narrower than other areas of the break tabs. The narrower areas maximize the likelihood that a fracture occurs at the junction and away from the end edge of the plates. In alternative embodiments, the break tab is of another shape having a necked configuration, or is a straight-sided rectangular bridge to the adjacent plate. In an embodiment where a disjunction location is determined independently of the shape of the break tab, as described in more detail below, the shape of the break tab is any feasible shape.

Figure 3A:
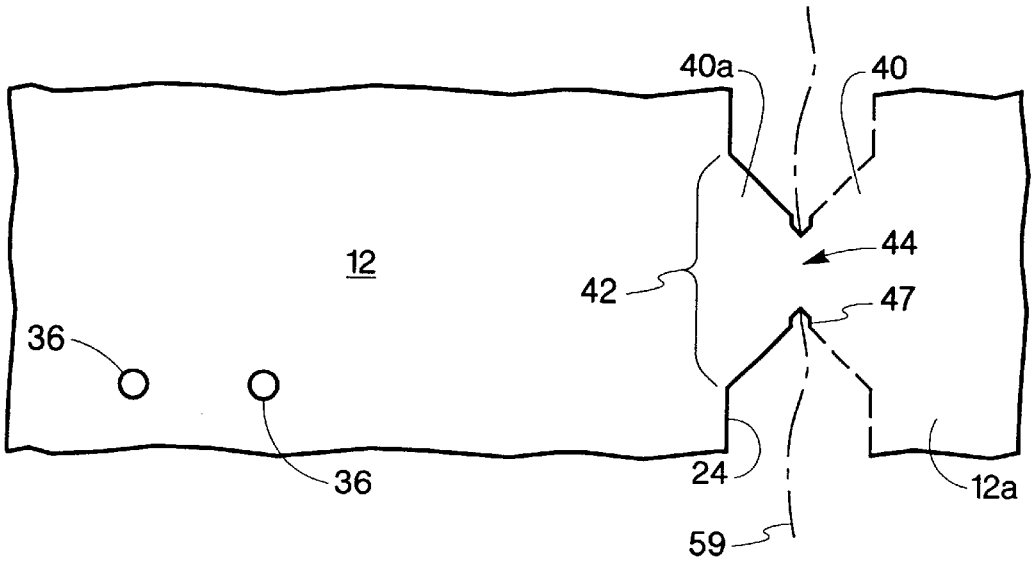
FIG. 3A is an enlarged view of section 3 of FIG. 2.
Figure 3B:
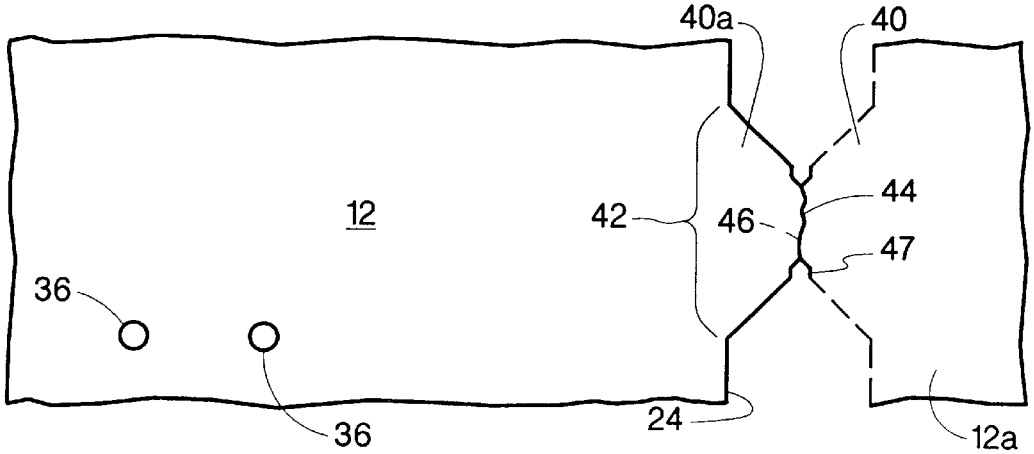
FIG. 3B is another embodiment of the enlarged view of section 3 of FIG. 2.

In the embodiment shown in FIG. 3A, the break tab 40*a* of sheet 12 and the break tab 40 of the adjacent sheet 12*a* are coupled when in a first position. FIG. 3B shows the break tabs 40, 40*a* in a second position, wherein the break tabs have been separated along break area 59, as described in more detail below.

As shown in FIGS. 3A and 3B, the break tab 40*a* has a wide base portion 42 coupled with and aligned with the end edge 24. The wide base portion 42 has a length that ranges from about 320 $\mu$m to 500 $\mu$m, depending upon the application. The break tab 40*a* extends away from the end edge 24, as the wide base portion 42 tapers to a nose portion 44. The break tab 40 of the adjacent sheet 12*a* also has a nose portion 46 that corresponds to the nose portion 44. The nose portion 44 has a length of about 180 $\mu$m for break tabs with shorter wide base portion lengths. At ends of the nose portion 44 and the nose portion 46 are indented (or concave) sections 47. These indented sections 47 are aligned with the break area 59.

Figure 4:
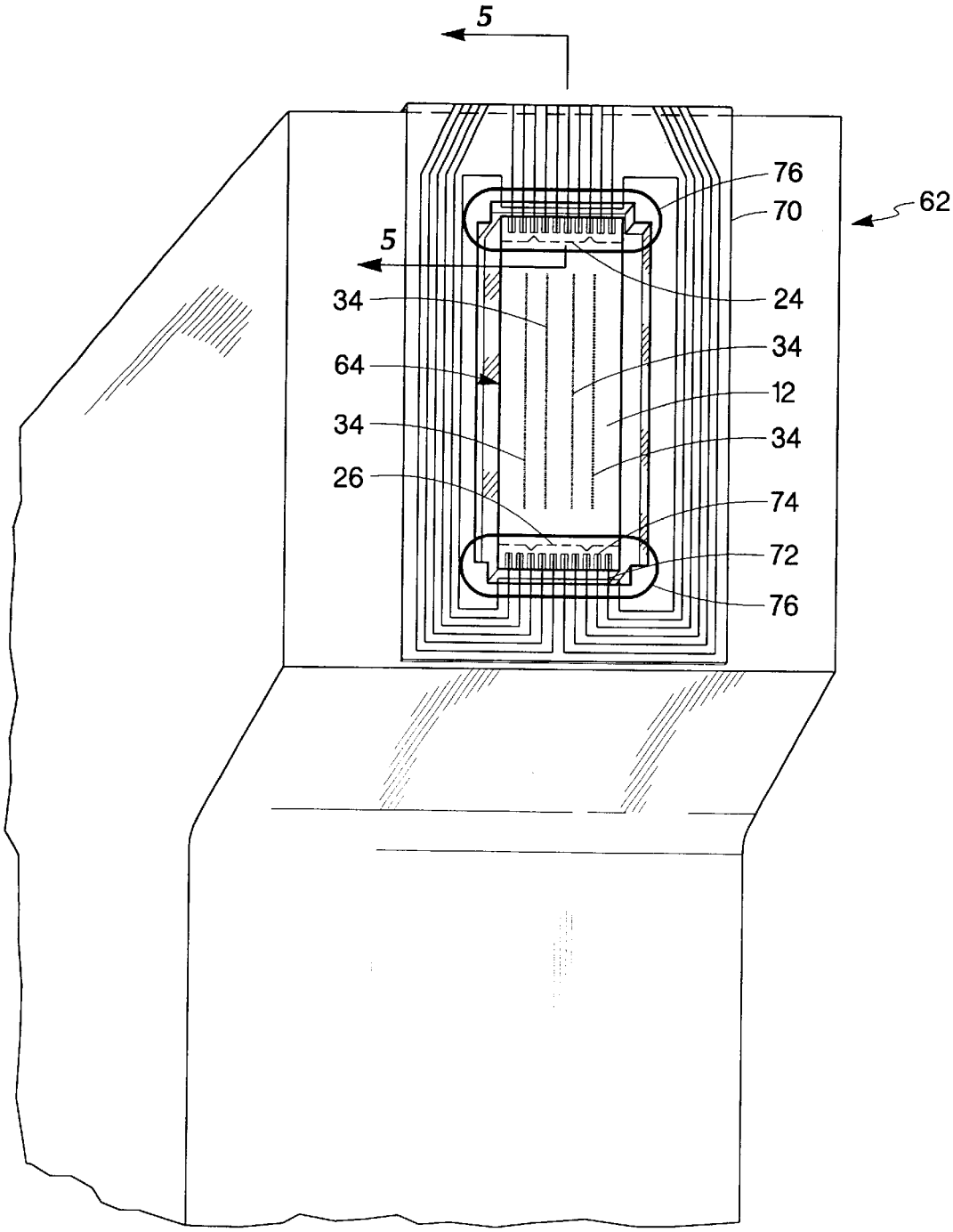
FIG. 4 is a perspective view of an ink jet cartridge including an orifice plate according to the embodiment of FIG. 1.

In the embodiment shown in FIG. 2, the break tabs are aligned along cut lines (or break lines or break areas) 59 and end segments 57. The break areas 59 are substantially straight, parallel gaps that define divisions between rows. The plates in the sheet are separated from each other upon separation of the break tabs at the break areas. In this embodiment, singulation of the plates is enabled by substantially parallel and straight cuts, as will be discussed below. As shown in FIG. 4, in one embodiment, after the plates are singulated, end surfaces 60 of the break tabs are exposed with the core plate material, while the rest of the plate 12 is plated.

In one embodiment, the singulation of the plates in the sheet is accomplished by bending the sheet at the break areas 59. In one embodiment, the break tabs are bent so sharply that they rupture and break, thereby breaking the plates apart from each other. In one embodiment, a tool is positioned along the break area, and the sheet is bent around the tool. In one embodiment, a sharp edge of the tool is placed along the break area. In another embodiment, a rolling cutter is rolled over the break area to bend and break the break tabs apart. In one embodiment, the break tabs are formed of a sufficiently brittle material to break in a substantially efficient manner.

In another embodiment, the singulation is conducted using a mechanical shear having a substantially straight line of cutting. The shear severs the plates of each row from those of the adjacent row by cutting the line of break tabs along cut lines 59, as illustrated in FIG. 2. The entire sheet is singulated by a sequence of shearing cuts, with a cut for each line of break tabs equal to the number of rows plus one additional cut. After these row cuts are made, the plates are entirely singulated. In one embodiment, a significant manufacturing rate of singulated orifice plates is achieved using this series of row cuts.

An alternative singulating process uses laser cutting of the break tabs along the break lines. In this embodiment, the break area 59 is determined independently of the shape of the break tab. Consequently, the shape of the break tab is any feasible shape. In other embodiments where the break area is determined independently of the break tab shape, the break tab has any feasible shape.

Figure 5:
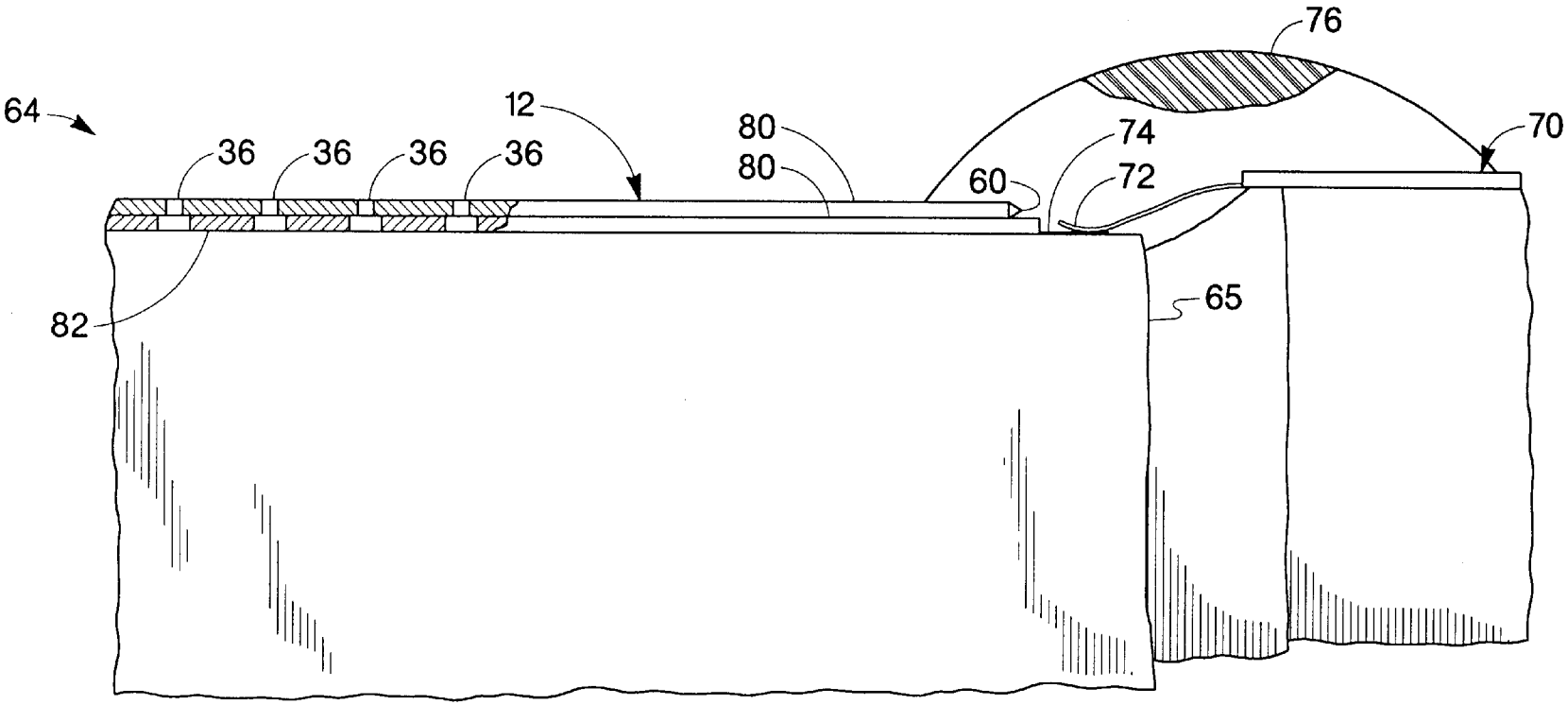
FIG. 5 is an enlarged schematic sectional view of the ink jet cartridge of FIG. 4, taken along section 5—5.

As shown in FIGS. 4 and 5, the singulated plate 12 is applied over a barrier layer 82. The barrier layer 82 defines firing chambers that align with the orifices 36 in the plate. Under the barrier layer 82 is an integrated circuit 65 with arrays of resistors corresponding to the firing chambers. The integrated circuit 65, together with the barrier layer and the orifice plate are part of a print head 64.

In the embodiment shown in FIG. 4, an inkjet cartridge body 62 has a recessed area for receipt of the print head 64. In one embodiment, the print head 64 is bonded to the cartridge body 62 with structural adhesive. In one embodiment, fluid conduit(s) are located at a bottom of the recessed area. The conduit conveys one or more colors of fluid from fluid chambers within the cartridge into a slot in the print head 64, which is fluidically coupled with the firing chambers. In one embodiment, the barrier layer 82 acts a gasket to prevent fluid flow between adjacent orifices. The fluid is heated in the firing chambers by the resistors and expelled from the corresponding nozzle orifice 36.

As shown in FIGS. 4 and 5, along ends of the print head 64 are bond pads 74. In one embodiment, there are 19 bond pads along each end. A circuit element 70 includes conductive tabs 72 that extend to contact with the bond pads 74. The circuit element 70 electrically couples the print head with a printer.

In one embodiment, an insulating layer 76 is applied at each end of the print head. In another embodiment, the insulating layer is a bead of encapsulant. In one embodiment, the layer 76 is room temperature vulcanizing silicon rubber. In another embodiment, the layer 76 is a low temperature curing epoxy-based material. In one embodiment, the insulating layer 76 protects elements that are covered from corrosion.

In one embodiment, the insulating layer 76 encapsulates the end surfaces 60 of the break tabs, the bond pad 74 and the conductive tabs 72. In one embodiment, the encapsulant covers the entire length of each end edge 24, 26, as well as extends onto the surface of the plate. The encapsulant extends at least partially into the end zone 56, described with regard to FIG. 2. In this embodiment, having the break tabs along the end edges 24, 26 allows encapsulation of the break tabs with a margin of error: the length of the end zone 56. In this manner, encapsulation of the orifices 36 is substantially avoided. In another embodiment, the encapsulant extends over less than 300 $\mu$m onto the surface of the plate.

In one embodiment, the exposed end surface of the break tab is not encapsulated by the insulating layer 76. In one embodiment, the core plate material does not negatively react with some fluid chemistries to which the embodiment is exposed.

Figure 6:
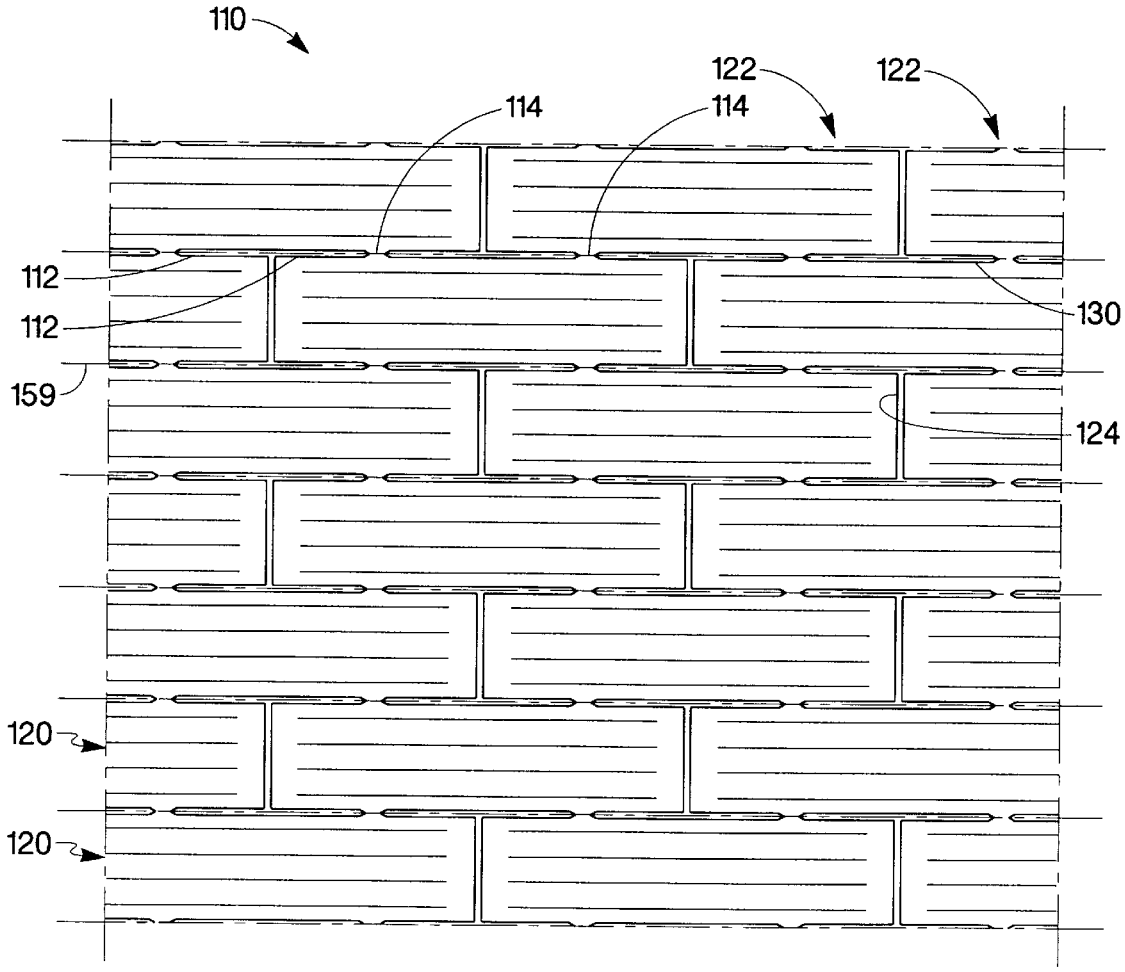
FIG. 6 is an enlarged plan view of an alternative configuration for a sheet of orifice plates.

FIG. 6 is a partial plan view of an alternative configuration of a sheet 110 of orifice plates 112. Unlike the embodiment of FIG. 2, the plates have break tabs 114 along side edges 130, instead of shorter end edges 124. Offset rows 120, staggered columns 122, and break tab 114 couplings in the sheet 110, as well as other features are similar to that described with respect to the embodiment of FIG. 2. Differences between this embodiment and that described with respect to FIG. 2 include orientation of the rows of the plates 112. In FIG. 6, the end edge 124 of the plate couples with the end edge 124 of the adjacent plate in the same row. In this arrangement, comparatively there are more rows 120 in the sheet, each row with fewer plates. In one embodiment, when the singulated plate 112 is positioned onto the rest of the printhead, the insulating layer 76 does cover the break tabs 114 along the side edges 130. In another embodiment, the insulating layer 76 does not cover the break tabs 114. Break areas 159 are similar to break areas 59 described with respect to FIG. 2.

Figure 7:
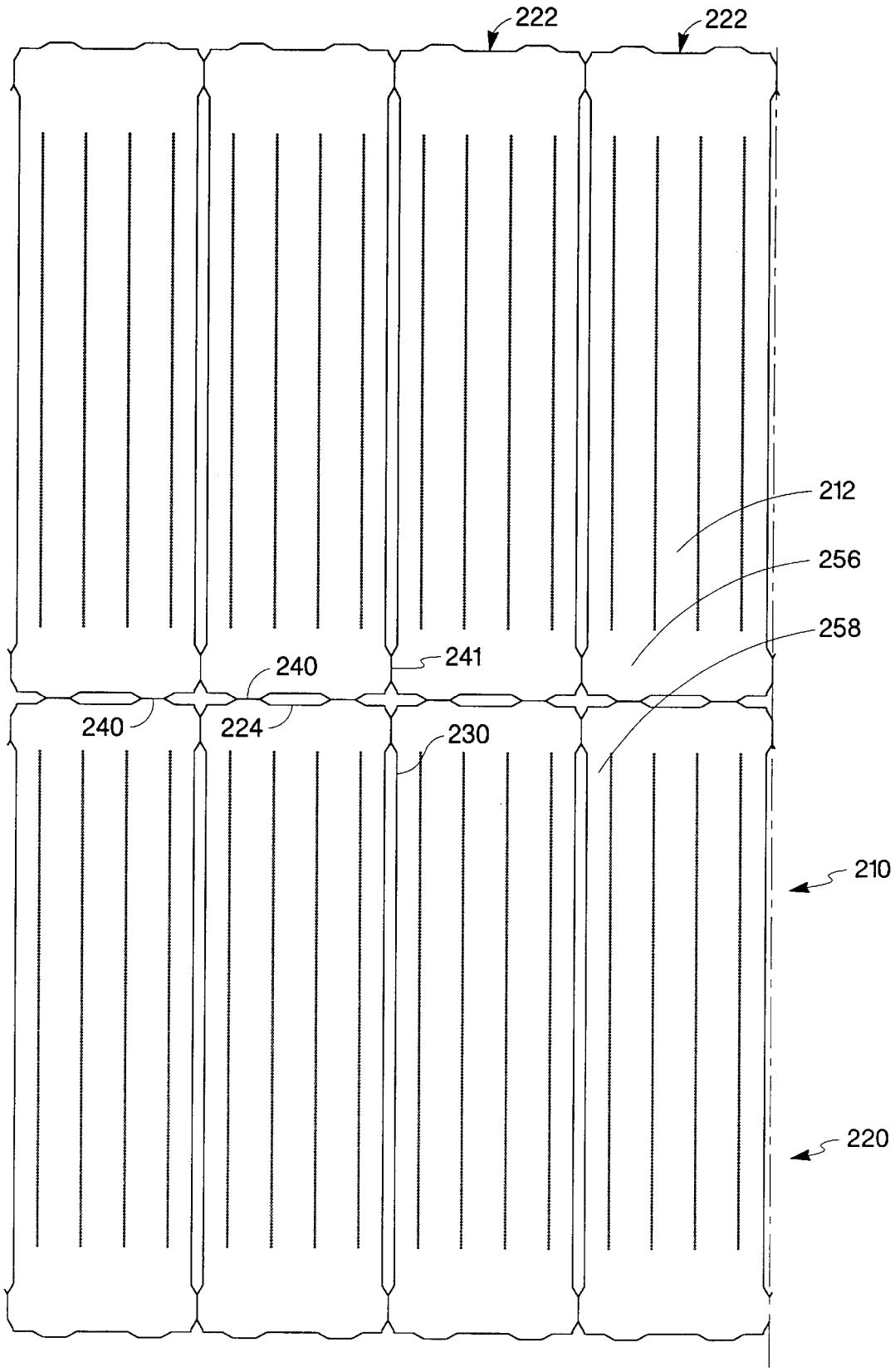
FIG. 7 is an enlarged plan view of another alternative configuration for a sheet of orifice plates.

FIG. 7 is a partial plan view of an alternative configuration of a sheet 210 of orifice plates 212. The embodiment is similar to the embodiment described with respect to FIG. 2. Similar to FIG. 2, the plates have break tabs 240 along end edges 224, and the plates have similar end zones 256. Unlike the embodiment of FIG. 2, the plates are aligned in both rows 220 and columns 222, as shown in FIG. 7. In addition, unlike FIG. 2, side edges 230 have break tabs 241 in the end zone 256. In this embodiment, when the singulated plate 212 is positioned onto the rest of the printhead, the insulating layer covers the break tabs 240 along the end edges 224, and covers the break tabs 241 along the side edges 230.

In contrast to the above described embodiment of FIG. 2, singulating the plates from the sheet 210, and other embodiments in which plates are laterally intercoupled, is less efficient. In particular, after the matrix is cut into separate rows, each row is then cut into individual plates, which substantially slows the singulation process. For example, in an embodiment where there are five rows and five columns, using the configuration of FIG. 2, there are six total cuts along the break areas in between the rows. However, using the configuration of FIG. 7, there would be six cuts in between the rows, and six cuts in between the columns, assuming that the individual rows remained substantially intact in the frame.

Figure 8:
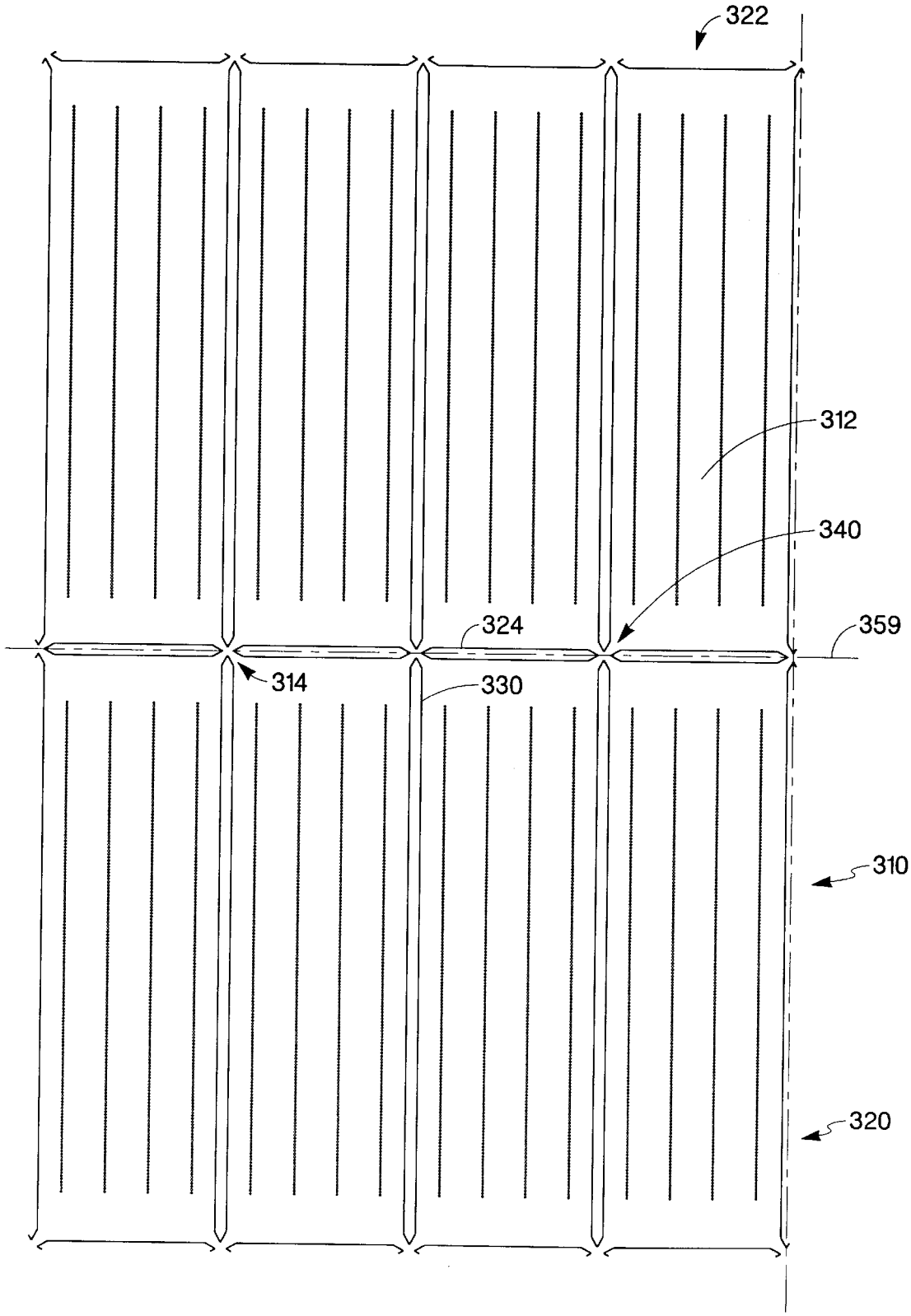
FIG. 8 is an enlarged plan view of another alternative configuration for a sheet of orifice plates.

FIG. 8 illustrates a partial plan view of an alternative configuration of a sheet 310 of plates 312. The embodiment is similar to the embodiment described with respect to FIG. 2. Unlike the embodiment of FIG. 2, the plates are aligned in both rows 320 and columns 322, as shown in FIG. 8. Also, in this embodiment, each plate 312 has break tabs 340 in each of four corners 314 of the plate. The break tabs are able to be separated from each other or cut in a similar manner along break area 359. Because the break tabs are along the break area 359, when the break tabs 340 are cut at the break area 359, the plates 312 singulate accordingly (similarly to the embodiment described in FIG. 2). Along an interior boundary of the frame, the plates 312 are coupled therewith at the corners 314. In this embodiment, when the singulated plate 312 is positioned onto the rest of the printhead, the insulating layer covers the end edges 324, and includes the corner break tabs 340.

Figure 9:
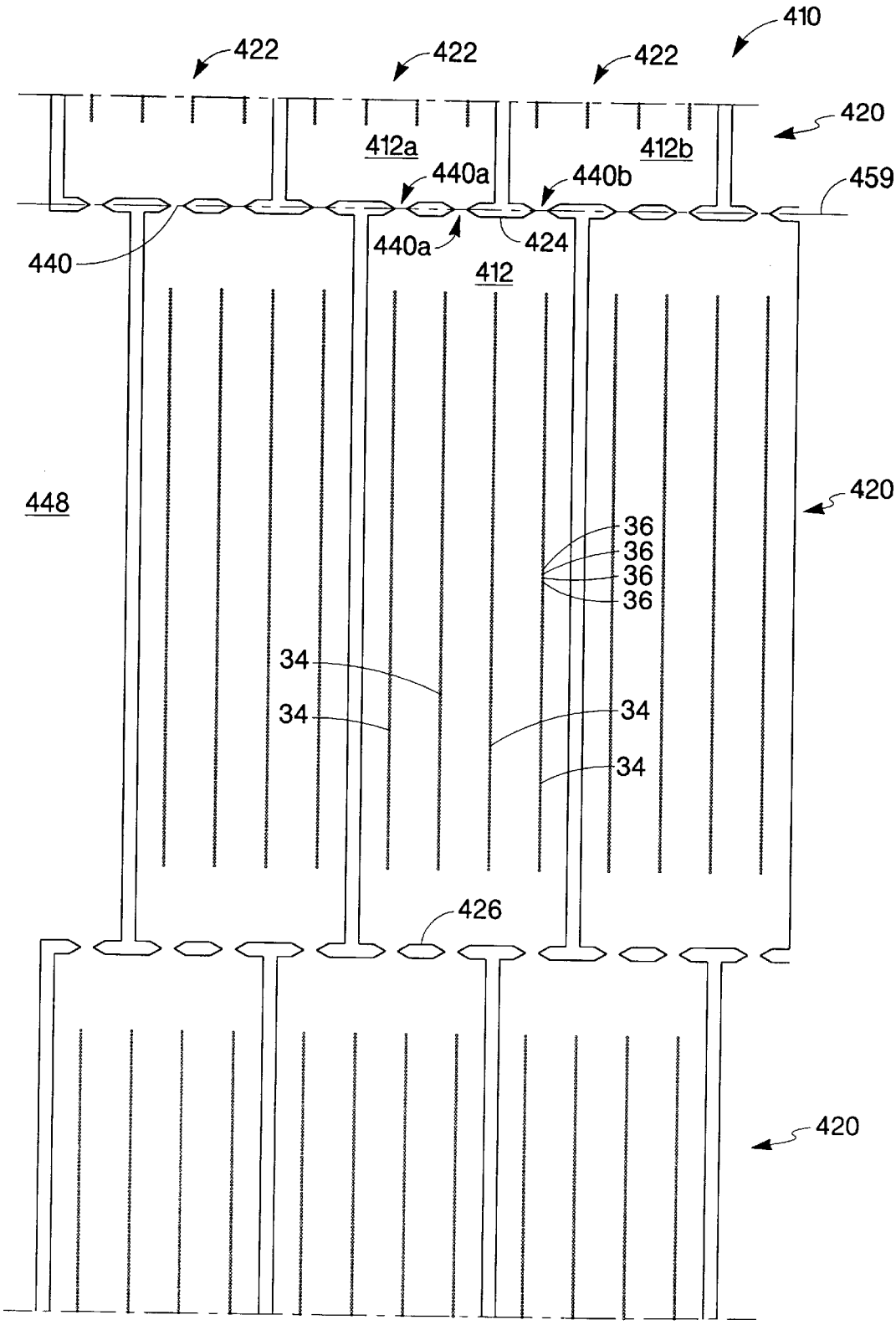
FIG. 9 is an enlarged plan view of another alternative configuration for a sheet of orifice plates.

FIG. 9 illustrates a partial plan view of an alternative configuration of a sheet 410 of plates 412. The embodiment is similar to the embodiment described with respect to FIG. 2. However, unlike the embodiment of FIG. 2, rows 420 of FIG. 9 are offset by about one-third (⅓) with respect to adjacent rows. In one embodiment, each plate 412 has three break tabs 440 along both end edges 424, 426. The break tabs 440 includes two break tabs 440*a*, and break tab 440*b*. The break tabs 440*a* couples the plate 412 with plate 412*a* in the adjacent row. The break tab 440*b* couples the plate 412 with plate 412*b* in the adjacent row. In one embodiment, each of the break tabs 440 are spaced from each other by a distance of about one-third (⅓) of an end edge length. The break tabs are able to be separated from each other or cut in a manner described above along break area 459.

Although this invention has been described in certain specific embodiments, many additional modifications and variations will be apparent to those skilled in the art. For example, in one embodiment the columns and rows in the sheet of plates are substantially aligned (similar to the embodiments shown in FIGS. 7 and 8). In another embodiment, the rows in the sheet are offset by less than half the width of the plate. In another embodiment, the rows in the sheet are offset by more than half the width of the plate. In one embodiment the rows are offset from each other by about ¼ of a plate width. In this embodiment, there are four (4) break tabs along each end edge. One of the four break tabs along the plate end edge is coupled with a first plate in an adjacent row, while the remaining three break tabs are coupled with a second plate adjacent the first plate in the adjacent row. In the embodiment, the break tabs are separated from each other along the row by about ¼ of the end edge length.

In one embodiment, there is one break tab on each end edge of the plate. In another embodiment, there are a plurality of break tabs on each end edge of the plate. In another embodiment, there are more than two (2) break tabs along each end edge of the plate. In one embodiment, the break tabs are symmetrical about a longitudinal axis in the plate. In one embodiment, the break tabs are in the corners of the plates as well as along the end edges of the plates.

In one embodiment, the break tabs are spaced apart along the end edge of the plate by greater than half the width of the plate. In one embodiment, the break tabs are spread out substantially evenly along the end edge of the plate. In another embodiment, the break tabs are spaced apart along the end edge of the plate by less than half of the width of the plate. In another embodiment, the break tabs are spread out substantially evenly along the row. In one embodiment with four break tabs, the break tabs are spaced apart in the row by about ¼ of the end edge length.

It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. A plate comprising:

a rectangular plate body having a plurality of nozzles;

first and second end zones in between the plurality of nozzles and opposing ends of the plate body, respectively;

a middle zone defined in between the first and second end zones;

opposing side edges extending between the first and second end zones;

a break tab in at least one of the first and second end zones, wherein the entire break tab is located between the side edges; and a plating material encapsulating the plate body in the middle zone.

2. The plate of claim 1 wherein the plating material encapsulates the side edges in the middle zone.

3. The plate of claim 1 wherein the break tab includes two first break tabs and two second break tabs, wherein the first break tabs extend from the first end zone and the second break tabs extend from the second end zone.

4. The plate of claim 1 further comprising first and second opposing end edges along the ends of the plate body, wherein the break tab includes two first break tabs along the first end edge, and two second break tabs along the second end edge.

5. The plate of claim 1 further comprising:

opposing end edges along the ends of the plate body; and a second break tab positioned along at least one of the opposing side edges.

6. The plate of claim 1 further comprising a gap extending the entire length of each side edge.

7. The plate of claim 1 wherein the opposing side edges are longitudinal edges of the plate body.

8. A method of manufacturing an ink jet cartridge, the method comprising:

attaching a print head to a cartridge body, wherein the print head has an elongated orifice plate with a plurality of orifices, and first and second end zones in between the plurality of orifices and opposing end edges of the plate, respectively, wherein the plate further has a middle zone defined in between the first and second end zones, and wherein the plate further has opposing side edges extending between the first and second end zones and a break tab in at least one of the first and second end zones, the break tab being located between the opposing side edges;

encapsulating the middle zone of the plate body with a plating material; and applying an encapsulant to at least a part of the first and second end zones.

9. The method of claim 8 wherein the opposing side edges are along longitudinal edges of the plate body, and wherein the plating material encapsulates the opposing side edges.

10. A method of manufacturing orifice plates, the method comprising:

forming a sheet with a plurality of plates, wherein the plurality of plates includes a first plate, wherein the first plate has a rectangular plate body having a plurality of orifice arrays, first and second end zones in between the plurality of orifice arrays and ends of the plate body, respectively, and a middle zone defined in between the first and second end zones;

forming a plurality of break tabs in between adjacent plates, wherein the plurality of break tabs includes a first break tab associated with the first plate, wherein the first break tab is in at least one of the first and second end zones and located between opposing side edges of the plate body; and encapsulating the middle zone of the plate body with a plating material.

11. The method of claim 10 wherein the plurality of break tabs includes a plurality of first break tabs of the first plate, the method further comprising coupling each first break tab of the first plate with a different adjacent plate.

12. The method of claim 10 wherein the plates are arranged in a plurality of rows, the method further comprising staggering adjacent rows of plates.

13. The method of claim 10 further comprising:

arranging the plates in a plurality of rows including adjacent rows; and defining break areas between adjacent rows, wherein the plurality of break tabs are positioned along the break areas.

14. The method of claim 13 further comprising singulating the plurality of plates by separating the adjacent rows at the break areas.

15. A break tab of an orifice plate comprising:

a base coupled with an end edge of the plate;

a nose portion opposite the base;

a pair of side edges coupling the base and the nose portion; and concave portions at junctions of the side edges and the nose portion, wherein the break tab is configured to break in the area of the concave portions.

16. The break tab of claim 15 wherein the base is wider than the nose portion.

* * * * *